US005236161A

United States Patent [19]

Haven

[11] Patent Number: 5,236,161

[45] Date of Patent: Aug. 17, 1993

[54] PAINT ROLLER TRAY AND LADDER ATTACHMENT

[76] Inventor: Robert M. Haven, 204 E. Emma, Lafayette, Colo. 80026

[21] Appl. No.: 891,998

[22] Filed: Jun. 1, 1992

[51] Int. Cl.[5] ..... E06C 7/14

[52] U.S. Cl. ..... 248/210; 182/129; 220/570; 248/110

[58] Field of Search ..... 248/210, 211, 238, 110, 248/111, 113; 182/129, 122; 220/570

[56] References Cited

U.S. PATENT DOCUMENTS

| | | | |
|---|---|---|---|
| 3,837,034 | 9/1974 | Leffert et al. | 220/570 X |
| 4,424,949 | 1/1984 | Kimmett et al. | 248/238 |
| 4,527,763 | 7/1985 | Woytowich | 248/238 |
| 4,624,430 | 11/1986 | Ehmke | 248/211 |
| 4,815,684 | 3/1989 | Kellstadt | 248/210 |
| 4,979,710 | 12/1990 | Baldwin | 248/210 |
| 5,031,723 | 7/1991 | Hooten | 248/211 X |
| 5,052,581 | 10/1991 | Christ et al. | 248/211 X |
| 5,123,620 | 6/1992 | Bourne | 248/210 |
| 5,135,193 | 8/1992 | Parris | 182/129 X |

FOREIGN PATENT DOCUMENTS

| | | | |
|---|---|---|---|
| 2536500 | 5/1984 | France | 248/211 |
| 0691189 | 5/1953 | United Kingdom | 248/211 |

*Primary Examiner*—Ramon O. Ramirez
*Attorney, Agent, or Firm*—John E. Reilly

[57] ABSTRACT

A paint roller tray is releasably attached to a side rail of the ladder by means of a bracket and clamping mechanism, the clamping mechanism being releasably engageable to either side rail and slidable along the slide rail as the painter moves up and down the ladder. The paint roller tray comprises an enlarged receptacle portion and a relatively narrow rectangular support portion which is releasably mounted on the bracket of the ladder attachment, and a brush holder is provided for releasably securing a brush to the support portion when the brush is not in use.

18 Claims, 2 Drawing Sheets

PAINT ROLLER TRAY AND LADDER ATTACHMENT

This invention relates to equipment support devices for ladders; and more particularly relates to a novel and improved paint tray assembly adapted for releasable attachment to a ladder, scaffold and the like.

BACKGROUND AND FIELD OF THE INVENTION

Ladders or scaffolding are customarily required for painting walls and ceilings. A particular problem in painting from a ladder is the necessity of carrying the paint and its receptacle up and down the ladder each time that the ladder has to be moved. Furthermore, paint trays and other receptacles used for retaining the paint for roller-type painting are particularly difficult to place on the ladder without danger of tipping or spilling. Moreover, the roller-type trays have limited capacity for storing paint as well as for securing brushes or rollers against accidentally dropping from the ladder when not in use.

In the past, various approaches have been taken to providing releasable holders for paint trays and other paint receptacles on a ladder. For example, U.S. Pat. No. 3,495,683 to O. C. Broden discloses an attachment for a paint tray which is inserted through a hollow rung of a ladder. U.S. Pat. No. 4,489,911 to J. Riley also requires insertion of attachment bars into spaced hollow rungs of a ladder in supporting a paint tray along one side of a ladder. U.S. Pat. No. 5,031,723 to Hooten includes a paint tray attachment for insertion through a single hollow rung of a ladder together with an external clamping device to clamp the attachment in position. U.S. Pat. No. 4,662,594 to R. Dubis similarly requires a resilient member which can be inserted within the rung of a ladder and expanded into locking engagement with the rung. U.S. Pat. No. 4,660,794 to W. R. Given relates to a work tray which ca be mounted by a shaft extending through a rung of the ladder and which also can be locked in place. U.S. Pat. No. 4,913,394 to R. Schmid provides an article holding tray for paint cans to be supported along one side of a ladder.

Other equipment support devices have been devised which do not require insertion into a hollow rung of the ladder and, for example, U.S. Pat. No. 4,527,763 to N. Wbytowich is directed to an attachment for a paint can which can be mounted on one side of the ladder without insertion into a rung. Also, U.S. Pat. No. 4,515,242 to P. LaChance discloses an attachment which can be externally mounted on the rung of a ladder to support a paint tray on one side of the ladder. Nevertheless, there is a continuing need for a paint tray ladder-supporting device which can be adjustably but firmly secured to one side of the ladder without insertion into a rung, which can be interchangeably mounted on either side of the ladder and which provides increased capacity for retention of paint while minimizing any danger of paint spillage and which is readily conformable for attachment to different types of ladders, such as, for example, step ladders or extension ladders whether made of wood or metal.

SUMMARY OF THE INVENTION

Accordingly, it is an object of the present invention to provide for a novel and improved ladder attachment which is adaptable for use in adjustably supporting different articles, such as, paint trays; and further wherein the ladder attachment can be interchangeably mounted on either side of the ladder.

It is another object of the present invention to provide a paint tray assembly adapted for releasable attachment to a side rail of a ladder and which is so constructed and arranged as to provide increased capacity for storage of paint while minimizing the danger of spillage.

A further object and feature of the present invention is to provide a novel and improved paint tray assembly specifically adaptable for use with roller-type applicators and which is specially designed for use in association with a ladder attachment and which has increased capacity for storage of paint as well as for retention of brushes or rollers when not in use.

It is a still further object of the present invention to provide for a novel and improved ladder attachment for paint tray assemblies and the like which is extremely versatile and conformable for attachment to different types of ladders as well as being interchangeable for attachment to either side of the ladder.

In accordance with the present invention, the paint tray assembly is adapted for releasable attachment to one side of opposite side rails of the ladder and comprises a paint tray having a bottom wall, side and end walls joined together to define a hollow interior receptacle for paint, a bracket member including a tray-support frame, releasable securing means between the tray and frame for releasably securing the tray onto the frame, and clamping means extending from the frame for clampingly engaging the side rail of the ladder whereby when the ladder is in an upwardly inclined position against a wall or other vertical surface the paint tray is supported in a substantially horizontal position so as to extend laterally and forwardly away from the side rail.

Preferably, the clamping means can be releasably attached to either side rail of the ladder depending upon whether the painter wishes to paint left-handed or right-handed; also, the clamping means is slidable along the side rail so as to more readily adjust to the desired elevation.

A particular characteristic and feature of the paint tray is that it is in the form of a shroud that forms a relatively deep receptacle for the paint and a shallow entrance facilitates movement of a paint roller or other applicator member into and away from the receptacle area for even distribution of the paint on its surface.

The above and other objects, advantages and features of the present invention will become more readily appreciated and understood from a consideration of the following detailed description when taken together with the accompanying drawings in which:

DETAILED DESCRIPTION OF THE PREFERRED EMBODIMENT

Figure 2:
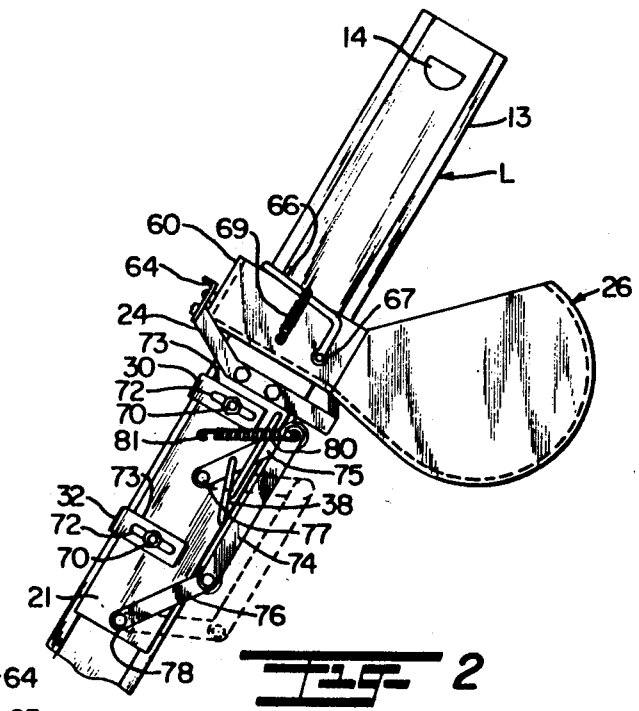
FIG. 2 is a side view in elevation of an upper portion of the ladder and illustrating the paint tray holder attached thereto in accordance with the present invention.
Figure 3:
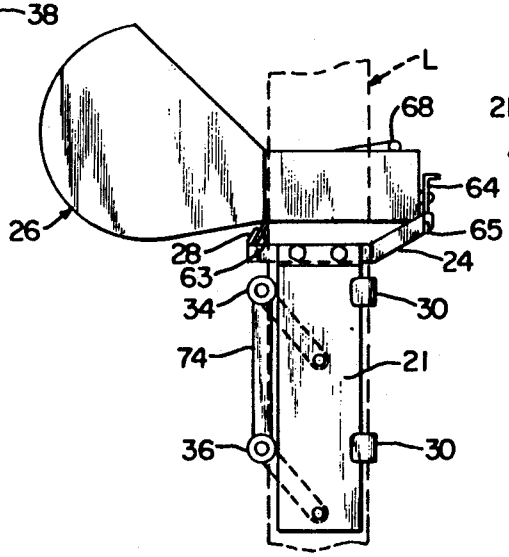
FIG. 3 is an opposite side view to that of FIG. 2 of the preferred form of paint tray holder.
Figure 1:
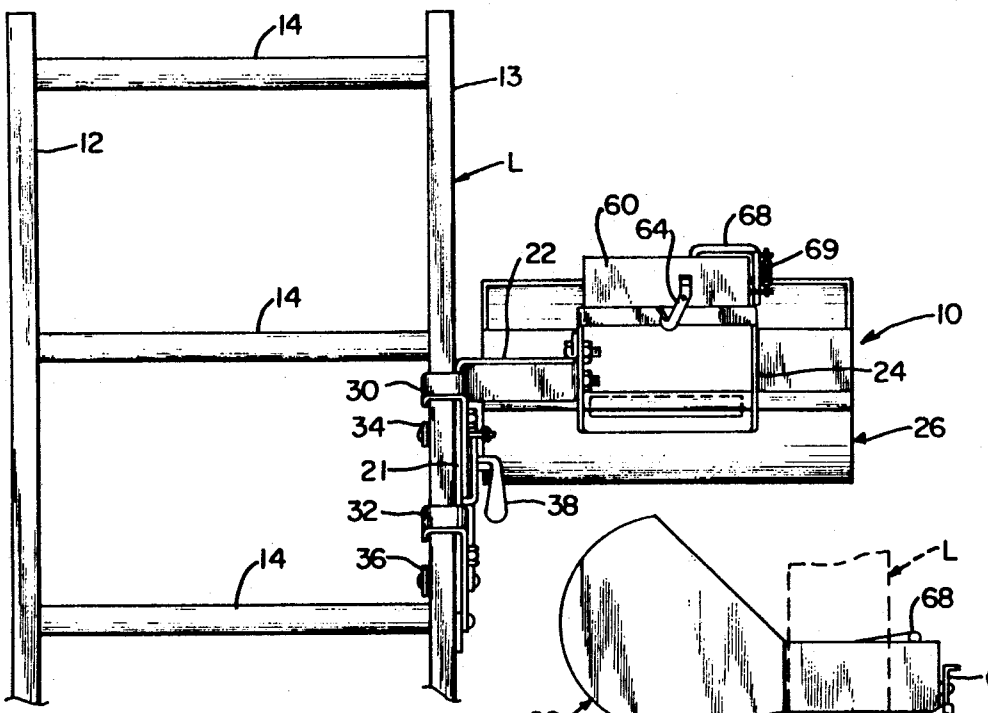
FIG. 1 is a somewhat fragmentary view in elevation of a ladder and illustrating a preferred form of paint tray holder attached thereto in accordance with the present invention.

Referring in more detail to the drawings, there is illustrated in FIGS. 1 to 3 the releasable attachment of a preferred form of paint tray holder 10 to a ladder L. For the purpose of illustration but not limitation, the ladder L is represented in an upright position as it would be positioned against a wall and includes opposite side rails 12 and 13, each of generally I-shaped cross-sectional configuration, and rungs 14 are disposed in a conventional manner at equally spaced intervals between the side rails 12 and 13. Again, the use of an aluminum ladder is given more as a setting for the present invention, and the holder 10 is readily conformable for use with various supporting elements, such as, for instance, extension ladders, step ladders, scaffolding, sills, etc.

Figure 7:
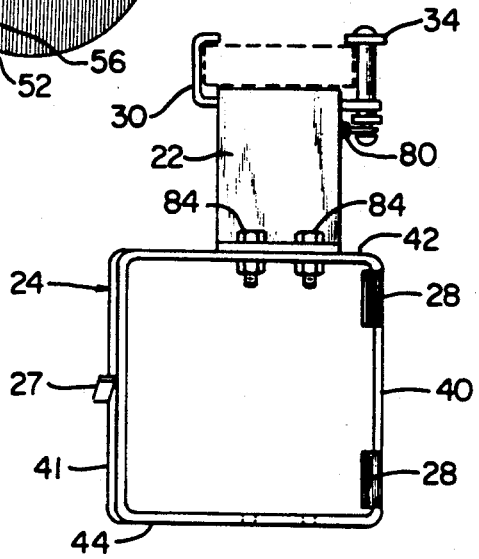
FIG. 7 is a top plan view of the preferred form of paint tray holder in accordance with the present invention.
Figure 5:
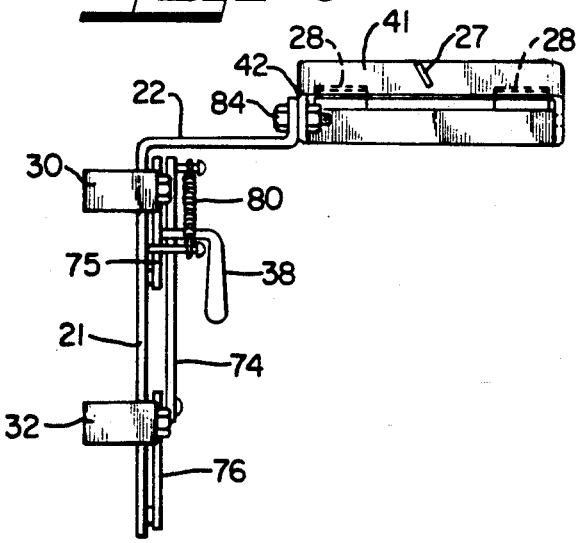
FIG. 5 is a front view of the preferred form of paint tray holder.
Figure 6:
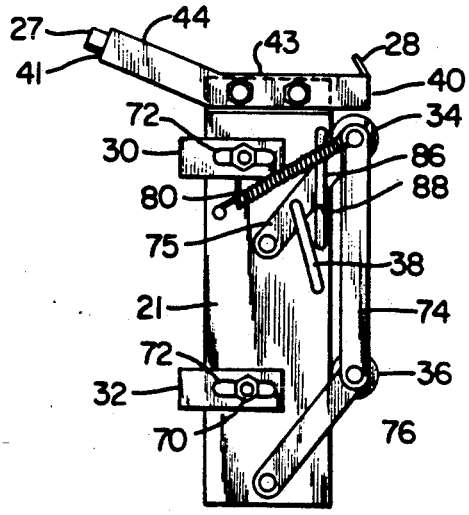
FIG. 6 is a side view in elevation of the paint tray holder illustrated in FIG. 5.

The preferred form of holder 10 is broadly comprised of a main support bracket 20 made up of a vertical arm 21 and horizontal arm 22 for attachment to one side of a generally rectangular, open frame 24, as best seen in FIGS. 5 to 7. The open frame 24 serves as the main support for a paint receptacle or tray as generally designated at 26 and with securing elements in the form of tabs 27 and 28 to releasably engage the tray 26 in a manner to be hereinafter described. In order to releasably engage one of the side rails 12 and 13 of the ladder L, a side rail clamp mechanism cooperates with the vertical arm 21 of the bracket 22 and includes upper and lower hooks 30 and 32 extending from the arm 21 of the bracket to engage a front surface of one of the rails 12 and 13; and upper and lower spring-loaded shafts or rollers 34 and 36 extend rearwardly from the arm 21 in aligned, facing relation to the hooks 30 and 32 to engage the back or opposite surface of the side rail 13 with a lever control arm 38 provided to release the rollers 34 and 36 from clamping engagement with the rail when desired to shift or change the position of the holder 10 on the ladder L.

Now considering in more detail the construction and arrangement of the open frame 24, a pair of spaced tabs 28 incline upwardly from one end frame portion 40, and the tab 27 projects forwardly from the center of front end frame portion 41. The end frame portions 40 and 41 are joined by side frame members 42 and 43 each including an inclined portion 44 which is angled upwardly toward the front end frame 41. The horizontal arm 22 of the bracket 20 is attached to the side frame portion 42, as best seen from FIG. 5.

A preferred form of paint roller tray 26 includes an enlarged, generally cylindrical receptacle portion 48 and a relatively narrow rectangular entrance and support portion 50. The receptacle portion 48 includes a generally semicircular wall 51 terminating in a lower edge 52 and upper edge 53 and closed at opposite ends by correspondingly semi-circular end wall panels 54 and 55. Both of the wall panels 54 and 55 terminate in vertical edges 56 which intersect with adjoining edges of generally rectangular side panels 58, the latter flanking opposite side walls 59 of the entrance portion 50. The portion 50 also includes an end panel 60 and a flat bottom wall panel 62 which has its rearward edge in adjoining sealed relation to the lower terminal edge 52 of the receptacle portion 46. In order to releasably attach the tray 46 to the frame 24, a downwardly and rearwardly inclined flange 63 extends from the lower terminal edge 52 for interfitting engagement with the tabs 28 in the manner shown in FIG. 2, and a pivotal latch member 64 includes a lower hook end portion 65 which is pivotal into engagement with the curved tab 27 as illustrated in FIG. 1. The entrance portion 50 is sized to fit directly over the open frame 24 with the cylindrical wall 48 extending rearwardly away from the flat bottom wall portion 62, the latter being somewhat in the form of a shroud having an upper inclined opening or space which forms the main entrance for a paint roller into the hollow interior of the receptacle 48.

Figure 4:
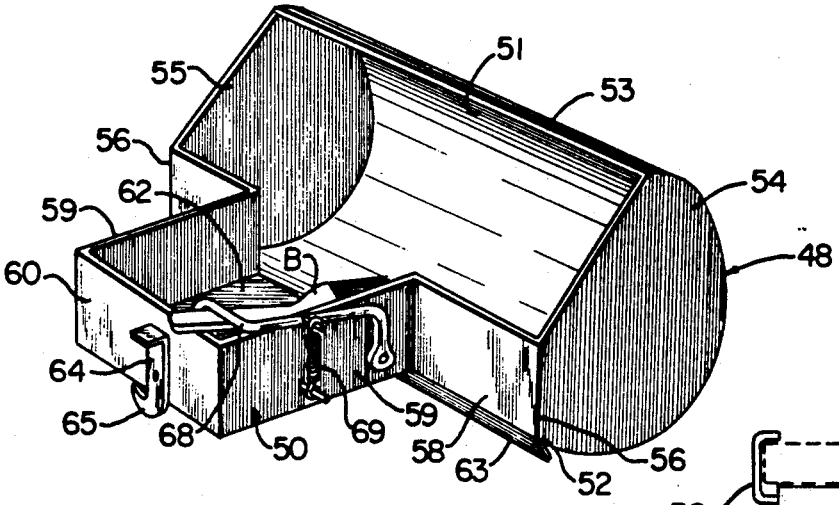
FIG. 4 is a perspective view of the preferred form of paint tray in accordance with the present invention.

The entrance portion 50 forms an extension of the entrance to the receptacle portion 48 so as to collect any overflow of paint as well as to serve as a retainer for paint brushes when not in use, for example, as represented at B in FIG. 4. In order to securely retain brush B in a raised position above the bottom wall of the entrance portion 50, a lever arm 66 is pivoted as at 67 and has an upper right angle and portion 68 at its free end which bears against an upper edge of the panel 59, as best seen from FIGS. 2 and 4. The lever arm 66 is yieldingly urged downwardly by a coiled spring element 69 so that the brush handle can be wedged between the free end 68 and the upper edge of the end panel 60. Of course, the paint tray 46 is primarily intended for use with paint rollers but also affords ready access for a paint brush so that the painter can interchangeably use a brush in addition to the roller as desired. In a corresponding manner, the handle of a roller may be wedged in position as described with reference to the paint brush handle B when the paint brush is in use.

An important feature of the present invention also resides in the clamping mechanism: The hook members 30 and 32 are preferably adjustably mounted on the vertical arm 21 by means of threaded fasteners 70 extending through elongated slots 72 in a connecting arm portion 73 which joins each hook end to the vertical arm. By loosening the threaded fasteners 70, the hook ends 30 and 32 can be moved or shifted toward and away from the edge of the vertical arm 21 in order to conform to different side rail dimensions or widths between the front and rear surfaces. The shafts 34 and 36 are interconnected by pivotal linkage including a link arm 74 interconnecting the shafts 34 and 36 and pivot arms 75 and 76 which extend between the shafts 34 and 36 and pivotal ends 77 and 78, respectively. A spring member 80 extends between the upper shaft 34 and fixed end 81 on the vertical arm to yieldingly urge the shafts 34 and 36 against the opposite surface of the side rail to that engaged by the hook ends 34 and 36. The manual control arm 38 extends downwardly from upper end 75 in order to pivot the shafts 34 and 36 away from clamping engagement with the side rail by manually turning the control arm 38 in a clockwise direction, as illustrated in FIG. 2, toward the front surface of the side rail 13.

The holder 10 is interchangeable for attachment to either side rail 12 or 13 of the ladder so that it can be used either for left or righthanded painting applications.

For example, to position the clamping mechanism on the lefthand side rail merely requires that the hooks 30 and 32 engage the rear surface of the rail 12 and the clamping rollers or shafts 34 and 36 engage the front surface of the rail, or just the reverse of that illustrated in FIG. 1. However, it is necessary to reverse the mounting of the open frame 24 with respect to the horizontal arm of the bracket 20 so that the opposite side frame 43 is attached to the horizontal arm 22 and the tray 26 extends rearwardly from its attachment to the frame 24. As illustrated in FIG. 7, this is accomplished by removing the fasteners 84 between the connecting flange at the end of the arm 22 and the side frame 42 and attaching to the opposite side frame 43, as illustrated in FIG. 6.

In use, the attachment 10 is mounted on a side rail 12 or 13 of the ladder by placing the hook ends 30 and 32 over the front surface of the side rail and expanding the rollers or shafts 34 and 36 outwardly by manipulation of the control arm 38 to the dotted line position illustrated in FIG. 2. When the control arm 38 is released, the rollers 34 and 36 will move into clamping engagement with the rear surface of the side rail. The paint tray 26 is then secured to the open frame 24 by means of the pivotal latch 64 and the interfitting tabs 63 and 28. Whenever it is desired to adjust the mounting of the attachment, it is necessary only to open the clamping mechanism slightly by turning the arm 38 and sliding the rollers 34 and 36 up or down the side rail of the ladder to the desired position followed by releasing the arm 38. If for any reason it is necessary or desirable to maintain the clamping mechanism in an open position, for example, the dotted line position illustrated in FIG. 2, a limit stop includes a bar 86 in overlying relation to the upper pivot arm 75 with a clamping mechanism and which bar is secured at upper and lower ends to the vertical arm 21 and is provided with a shoulder 88. The pivot arm 75 is slidable through the space formed between the member 86 and arm 21; and, when pivoted to the dotted line position shown in FIG. 2, the arm 75 can be moved into engagement with the shoulder 88 to hold the clamping mechanism in the open position.

Figure 8:
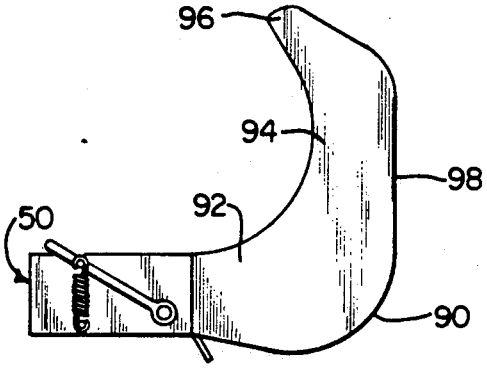
FIG. 8 is a side view of a modified form of paint roller tray.

A modified form of paint roller is illustrated in FIG. 8 wherein like parts are correspondingly enumerated to those of the preferred form. In the modified form, a paint roller tray 26' includes a generally cylindrical receptacle portion 90 which forms a continuation of the entrance portion 50. The receptacle portion 90 has opposed end wall panels 92 which extend upwardly from the lower cylindrical portion 90 into relatively straight sections 94 and terminate in upper reverse curved sections 96. The end wall panels are joined by a common wall 98, and the lower cylindrical portion 90 is joined to the entrance 50 in the same manner as illustrated in the preferred form between the receptacle portion 48 and entrance portion 50. The modified form of tray as described offers the advantage of permitting the paint roller to be dipped into the paint and then advanced upwardly along the straight section of the receptacle to remove excess paint from the roller prior to application to the surface being painted.

It is therefore to be understood that while preferred and modified forms of invention are herein set forth and described, various other modifications and changes may be made therein without departing from the spirit and scope of the present invention as defined by the appended claims and reasonable equivalents thereof.

I claim:

1. A paint tray assembly for releasable attachment to a side rail of opposite side rails of a ladder comprising:

a paint tray having a bottom wall, side and end walls joined together to define a hollow interior receptacle for paint;

a bracket member including a tray-support frame, and releasable securing means between said tray and said frame for releasably securing said tray onto said frame; and clamping means extending from said bracket member including roller members for clampingly engaging the side rail of the ladder whereby when said ladder is in an upwardly inclined position against a wall or other vertical surface said paint tray is supported in a substantially horizontal position extending laterally and forwardly away from said side rail.

2. A paint tray assembly according to claim 1, said clamping means being slidable along said side rail without removal of said clamping means from said side rail.

3. A paint tray assembly according to claim 1, said clamping means including means releasably attaching said clamping means to said bracket member for interchangeable attachment of said clamping means to one of said opposite side rails of said ladder.

4. A paint tray assembly according to claim 3, said clamping means extending downwardly from said bracket member.

5. A paint tray assembly according to claim 1, said clamping means having spaced upper and lower hooks engageable with one edge of said side rail and said movable roller members engageable with an opposite edge to said one edge of said side rail, and spring-loading means normally urging said clamp members into firm engagement with said opposite edge of said side rail.

6. A paint tray assembly according to claim 5, said clamping means including a bearing surface of generally elongated configuration, said hooks and said clamp members disposed for lateral extension away from said bearing surface to form a track therebetween for insertion of a portion of said side rail therebetween.

7. A paint tray assembly according to claim 6, said bearing surface being of elongated, flat rectangular configuration, and said hooks and said clamp members being disposed at opposite corners of said bearing surface.

8. A paint tray assembly according to claim 7, said clamping means including pivotal arm members pivotally connected to said bearing surface with said clamp members disposed at free ends of said pivotal arm members, and said spring-loading means defined by return spring elements extending between said bearing surface and said free ends of said pivotal arm members.

9. A paint tray assembly according to claim 1, said bottom wall portion resting on said tray-support frame and a generally cylindrical portion extending from said bottom wall portion.

10. A paint tray assembly according to claim 9 said generally cylindrical bottom wall portion being in the form of a shroud having an opening in said cylindrical wall portion defining an entrance to said hollow interior or said paint tray.

11. A paint tray assembly according to claim 1, said paint tray including a generally cylindrical wall portion extending substantially horizontally away from said bottom wall portion, and a straight wall portion extending upwardly from said generally cylindrical wall portion, said cylindrical wall portion and said straight wall portion having opposite end walls to define a receptacle for paint therein.

12. A paint tray assembly adapted for releasable attachment to a side rail of opposite side rails of a ladder comprising:

a paint tray having a bottom wall, side and end walls joined together to define a hollow interior receptacle for paint;

a bracket member including a tray-support frame, and releasable securing means between said tray and said frame for releasably securing said tray onto said frame, said releasable securing means including interlocking retainer tabs between said frame and said bottom wall of said tray, and latching means between said frame and an end wall of said tray; and clamping means extending from said bracket member for clampingly engaging the side rail of the ladder whereby when said ladder is in an upwardly inclined position against a wall or other vertical surface said paint tray is supported in a substantially horizontal position extending laterally and forwardly away from said side rail.

13. A paint tray assembly according to claim 12, said latching means disposed on a front end wall of said tray.

14. In a paint tray assembly wherein a ladder attachment is provided for releasable engagement with a side rail of a ladder, and a support frame is provided for supporting a paint roller tray thereon, the improvement comprising:

said paint roller tray comprising an enlarged, generally cylindrical receptacle portion and a narrow rectangular support portion, said support portion including a bottom wall portion engageable with said support frame, means for releasably attaching said support portion to said support frame, and said receptacle portion including a generally cylindrical wall portion extending forwardly away from said support portion, and end wall panels at opposite ends of said cylindrical portion to define a hollow interior receptacle for paint.

15. In a paint tray assembly according to claim 14, said paint roller t ay including a generally cylindrical wall portion extending substantially horizontally away from said bottom wall portion and a straight wall portion extending upwardly from said generally cylindrical wall portion, said cylindrical wall portion and said straight wall portion having opposite end walls to define a receptacle for paint therein.

16. In a paint tray assembly according to claim 14, said rectangular support portion including side and end walls joined together to define a shallow receptacle in communication with said generally cylindrical receptacle portion.

17. In a paint tray assembly according to claim 16, said paint roller tray including a spring-loaded brush-holder attached to one of said sidewalls.

18. In a paint tray assembly according to claim 17, said brush holder including a lever arm member pivotally attached to one of said sidewalls, said lever arm having an upper free end overlying an upper edge of said one of said sidewalls, and means normally urging said free end of said lever arm against said upper edge of said one of said sidewalls.

* * * * *